United States Patent [19]

Dawley

[11] Patent Number: 4,518,266

[45] Date of Patent: May 21, 1985

[54] SWIMMER'S LAP PACER

[76] Inventor: Dale K. Dawley, 5845 Red Apple Ridge, Columbus, Ohio 43227

[21] Appl. No.: 517,681

[22] Filed: Jul. 27, 1983

[51] Int. Cl.[3] ..... G04B 19/24; G04F 8/00

[52] U.S. Cl. ..... 368/10; 368/107; 272/4; 340/323 R

[58] Field of Search ..... 368/107, 10; 340/323 R; 200/52 R; 272/4, 7, 105

[56] References Cited

U.S. PATENT DOCUMENTS 3,302,007 1/1967 Parkinson ..... 368/107

3,916,214 10/1975 Coble, Jr. et al. ..... 200/52 R 3,944,763 3/1976 Beiewaltes ..... 340/323 R 4,216,956 8/1980 Yamamura et al. ..... 340/323 R

FOREIGN PATENT DOCUMENTS 1499528 10/1969 Fed. Rep. of Germany ..... 340/323

*Primary Examiner*—Bernard Roskoski

[57] ABSTRACT

This invention is a device for keeping track of swimmer's time and distance; including a case containing a split timer, an elapsed timer and a lap counter in an electric circuit activated by a kickpad contacted by the swimmer at each lap.

1 Claim, 3 Drawing Figures

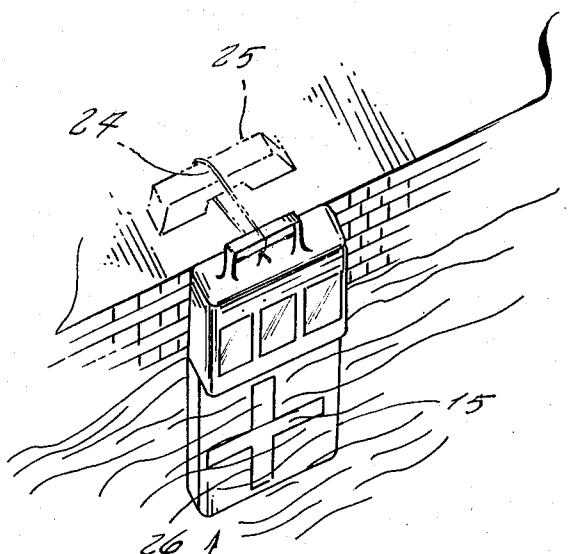
Fig. 2
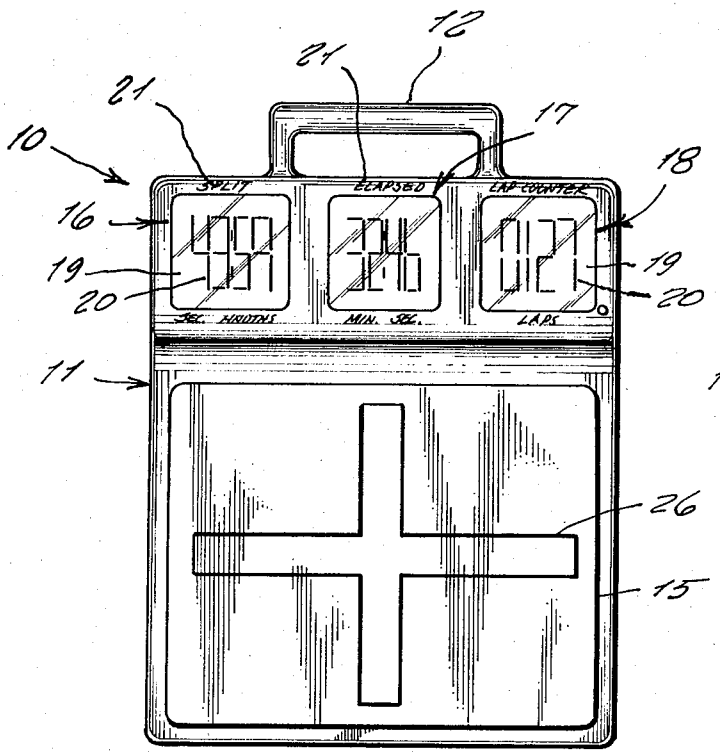
Fig. 1
Fig. 3

SWIMMER'S LAP PACER

This invention relates generally to swimming competition accessories. More specifically, it relates to timing and counting instruments.

It is well known that, in all physically active sports, an accurate timing and scoring of an athlete's performance is closely observed, for precise competitive comparisons. Thus, in practically all racing sports, stop watches and counters are often employed by observers of the event. However, a greater precision of reading may always be obtained if the timing and counting instruments are activated directly by the performer instead. This applies also in the sport of swim racing, such as often takes place in public swimming pools.

Accordingly, it is a principal object of the present invention to provide an instrument that counts and records the number of laps made across the pool by a swimmer, and counts and records the time taken for this accomplishment; the instrument being directly activated by the swimmer himself, so that the reading is precisely accurate, and cannot be disputed.

Another object is to provide a swimmer's lap pacer, which, in addition to being useful in a competitive race of several swimmers, is also useful to an individual swimmer, then practicing alone and trying to improve himself.

Yet another object is to provide a swimmer's lap pacer, which is quick and easy to set up at an edge of a pool, so that it is conveniently activated by the swimmer each time that he swims by it.

Other objects are to provide a swimmer's lap pacer, which is simple in design, inexpensive to manufacture, rugged in construction, easy to use, and efficient in operation.

These, and other objects, will be readily evident, upon a study of the following specification, and the accompanying drawing, wherein:

FIG. 1 is a front elevational view of the invention;

FIG. 2 is a side elevational view thereof, and

FIG. 3 is a front perspective view thereof, shown installed at an edge of a swimming pool.

Referring now to the drawing in greater detail, the reference numeral 10 represents a swimmer's lap pacer, according to the present invention, wherein there is a molded plastic case 11, formed with a carrying handle 12 on its top. The case is sealed, in order to prevent entry of swimming pool water thereinto. A soft grip padding 13 may be provided on its flat rear side, for resting against a pool side wall 14.

A front side of the case includes a depressible kickpad 15 at its lower portion, in order to be underwater, as shown in FIG. 1, when the device is installed at the pool. The upper portion of the front side is intended to be above the water surface, in order that a row of three displays 16, 17 and 18 therein may be clearly seen. Each display includes a window opening, that is sealed watertight by a transparent window pane 19, so as to permit observation therethrough of a digital readout 20, as shown. Each of the displays is labeled with an identification 21, indicating the specific display. Thus, the displays 16 and 17 indicate split and lapsed movement of time, while the display 18 indicates a measurement of distance. The display 16 is a timer, showing seconds of time split into hundredths, while the display 17 is a timer showing elapsed time in minutes and seconds. The display 18 is a lap counter, that keeps score of the number of laps covered in a competitive race or in a personal workout. All the readouts are produced by mechanisms (not shown) in an electrical circuit contained inside the case, and which is powered by replaceable dry cell batteries inserted into a chamber sealed by a closure cap 22.

Two water-tight buttons 23 are provided along each opposite side of the case. On the left side, one button serves to reset the elapsed timer, and the other button serves to reset the lap counter. On the right side, one button controls an on-off power switch, and the other button controls the readout display illumination.

For use, the device is installed at one end of the pool, by being suspended on a nylon cord 24 secured to any stationary nearby object, or to a heavy weight 25 placed upon the pool deck.

In operative use, a swimmer kicks or contacts the kickpad, as he turns at the end of a lap. A large design, such as a cross 26, shown in the drawing, aids the swimmer to find the kickpad when looking underwater. When kicked, the kickpad flexes so as to activate a mechanism inside the case that effects the display circuit.

The split timer measures the time between the kicks or contacts with the kickpad, thus defining the time length of a lap. With each contact, the display holds the accumulated time about three seconds, while a timer resets and counts new lap time. The display then synchronizes with the timer and resumes.

The elapsed timer measures the time from the first contact of the kickpad and pauses about three seconds after each following contact, displaying accumulated time, then "catching up" and displaying continuing clock count. After completion of a competition race or individual workout, the elapsed timer button may be manually reset for the next use of the device.

The lap counter counts and totals up the number of laps that are made. After the counting is finished, the lap counter button is manually reset.

The on-off switch button resets all the displays to zero.

While various changes may be made in the detail construction, it is understood that such changes will be within the spirit and scope of the present invention, as is defined by the appended claims.

What I claim as new, is:

1. A swimmer's lap pacer, comprising, in combination, a waterproof case containing a split timer, an elapsed timer and a lap counter in an electrical circuit, a "U"-shaped carrying handle upon an upper side of said case for being either held in a hand or receiving a tethering cord therearound, when said pacer is suspended over a swimming pool edge; said case including a front wall, an upper part of said front wall comprising an above-water portion having displays for said split timer, elapsed timer and lap counter, a depressible kickpad on a lower, underwater portion of said front wall, and a mechanism inside said case operated by said kickpad, for activating said electrical circuit.

* * * * *